US008142543B2

(12) United States Patent
Cameron et al.

(10) Patent No.: US 8,142,543 B2
(45) **Date of Patent: *Mar. 27, 2012**

(54) REFINING FERROALLOYS

(75) Inventors: Andrew Miller Cameron, Tansley (GB); Christian Juan Feldermann, Banyoles (ES)

(73) Assignee: The BOC Group plc, Windlesham (GB)

( * ) Notice: Subject to any disclaimer, the term of this patent is extended or adjusted under 35 U.S.C. 154(b) by 1396 days.

This patent is subject to a terminal disclaimer.

(21) Appl. No.: 10/517,906

(22) PCT Filed: Jun. 9, 2003

(86) PCT No.: PCT/GB03/02464

§ 371 (c)(1),
(2), (4) Date: Nov. 7, 2005

(87) PCT Pub. No.: WO03/104508

PCT Pub. Date: Dec. 18, 2003

(65) Prior Publication Data

US 2006/0060028 A1 Mar. 23, 2006

(30) Foreign Application Priority Data

Jun. 11, 2002 (GB) ..... 0213376.7

(51) Int. Cl.
*C21C 5/32* (2006.01)

(52) U.S. Cl. ..... 75/533; 75/528

(58) Field of Classification Search ..... 75/533, 75/528

See application file for complete search history.

(56) References Cited

U.S. PATENT DOCUMENTS

| | | | | |
|---|---|---|---|---|
| 4,139,370 | A | 2/1979 | Breuer et al. | |
| 4,425,223 | A * | 1/1984 | Miller | 208/48 AA |
| 4,434,005 | A * | 2/1984 | Metz et al. | 75/532 |
| 4,730,813 | A | 3/1988 | Bock et al. | |
| 5,366,537 | A * | 11/1994 | Schlichting | 75/528 |
| 6,244,854 | B1 | 6/2001 | Satchell, Jr. et al. | |
| 6,250,915 | B1 | 6/2001 | Satchell, Jr. et al. | |
| 6,322,610 | B1 | 11/2001 | Morsut et al. | |
| 6,409,793 | B1 * | 6/2002 | Edlinger | 75/10.35 |
| 6,558,614 | B1 * | 5/2003 | Fritz | 266/44 |
| 6,684,796 | B1 | 2/2004 | Feldermann | |
| 2006/0060028 | A1 | 3/2006 | Cameron et al. | |

FOREIGN PATENT DOCUMENTS

| | | | |
|---|---|---|---|
| EP | 0 081 448 | | 6/1983 |
| EP | 0 874 194 | | 10/1998 |
| EP | 0 965 649 | | 12/1999 |
| EP | 1092785 | * | 4/2001 |

(Continued)

OTHER PUBLICATIONS

Higuchi, JP08-092627 English abstract and Machine Translation, Apr. 1996.*

(Continued)

*Primary Examiner* — Jie Yang
(74) *Attorney, Agent, or Firm* — Joshua L. Cohen

(57) ABSTRACT

A method of refining a ferroalloy includes the step of blowing molecular oxygen or a gas mixture including molecular oxygen into a melt of the ferroalloy. A metallurgically acceptable particulate material is introduced from above into the melt. The particulate material is carried into the melt in a first supersonic gas jet which travels to the melt shrouded by a second gas jet.

34 Claims, 3 Drawing Sheets

FOREIGN PATENT DOCUMENTS

| | | | |
|---|---|---|---|
| EP | 01092785 | | 4/2001 |
| EP | 0 866 139 | | 7/2002 |
| GB | A2054655 | | 2/1981 |
| GB | 2122649 | | 1/1984 |
| JP | 58207313 | | 12/1983 |
| JP | 59159963 | | 9/1984 |
| JP | 61106744 | | 5/1986 |
| JP | 61284512 | | 12/1986 |
| JP | 62230953 | * | 10/1987 |
| JP | 04254510 | | 9/1992 |
| JP | 08092627 | * | 4/1996 |

OTHER PUBLICATIONS

Yamamoto, JP62230953 English abstract, Oct. 1987.*

Habashi F.: "Handbook of Extractive Metallurgy, vol. I" 1997, Wiley VCH, Weinheim RFG XP002256075 ISBN: 3-527-28792-2 p. 445, left-hand column, paragraph First; Figures 6.61,6.62 p. 435; Figure 7.17.

* cited by examiner

REFINING FERROALLOYS

BACKGROUND OF THE INVENTION

This invention relates to the manufacture of ferrous alloys by a process including an oxygen refining step. The oxygen refining step may typically comprise decarburisation but may alternatively or additionally comprise removal of silicon or manganese.

Intermediate carbon ferrochrome is made commercially by the partial oxidation of the carbon content of so called "charge chrome", an alloy of iron and chromium containing a relatively high proportion of carbon (typically in the order of 6 percent by weight). (Ferrochrome is another name for ferrochromium.) The partial oxidation is effected in a converter by blowing a mixture of oxygen and steam through the molten alloy by means of one or more submerged tuyeres. A ferrochrome product containing less than 2% by weight of carbon can be produced. A slag is formed during the oxidation that can contain a substantial amount of chromium oxide. The chromium oxide is typically recovered by the addition of a ferrosilicon reductant at the end of the process cycle. Nevertheless, some chromium oxide is lost in the slag that is formed in this primary reduction step.

A reduced carbon ferromanganese can be made commercially by an analogous process to that described above for the manufacture of ferrochrome.

Stainless steel is a low carbon ferrous alloy typically including chromium and nickel as alloying elements. A typical composition contains 18% by weight of chromium, 8% by weight of nickel, less than 0.1% by weight of carbon, the balance being iron and any other alloying elements (excluding incidental impurities). Stainless steel is typically made by melting a charge of stainless steel scrap and high carbon ferroalloys in an electric arc furnace to form a crude alloy containing up to 0.5% by weight more chromium than is desired in the product and having a carbon content in the range of 0.25% to 2% by weight and a silicon content in the range of 0.2% to 1.5% by weight. The particular levels of carbon and silicon depend on the product specification, steel making practice and vessel size. The crude alloy is transferred in molten state to a converter in which the molten alloy is blown from beneath the surface with oxygen so as to oxidise the carbon to carbon monoxide and thus decrease the carbon content of the resultant stainless steel to less than 0.1% by weight. As the carbon level progressively decreases during the blow, so there is a tendency for the oxygen to react with the chromium to form chromium oxide. There is also an associated tendency for an excessive temperature to be created in the converter because of the exothermic nature of the oxidation reactions. In the Argon-Oxygen Decarburisation (AOD) process this tendency is counteracted by progressively, or in steps, diluting the oxygen with argon so as to reduce the partial pressure of carbon monoxide and so promote carbon oxidation in preference to oxidation of chromium. By these means most of the chromium is retained in the bath and temperature increases can be restricted to an acceptable level (for example to a temperature no higher than 1750° C.). In a typical example, the blow is commenced with an argon-oxygen ratio (by volume) of 1:3 and may finish with an argon-oxygen ratio (by volume) of 2:1. After the blow, some ferrosilicon can be added to reduce chromium oxide in the slag, and lime can be introduced as a desulphurisation agent.

The Creusot-Loire-Uddeholm (CLU) process may be used as an alternative to the AOD process. The CLU process is analogous to the AOD process but typically uses a mixture of steam, nitrogen and argon instead of pure argon to dilute the oxygen that is blown into the melt from beneath its surface.

All the processes mentioned above have in common the refining with oxygen of a ferroalloy having an appreciable carbon content in order to reduce its carbon content. Even with the dilution of the oxygen with, for example, argon, these processes still exhibit a tendency towards progressive damage of the refractory lining of the converter particularly in the vicinity of each tuyere through which the oxygen is blown. Regular relining of the converter is therefore necessary.

U.S. Pat. No. 4,434,005 discloses a method for refining a molten metal overlain by a slag and which cold solids are introduced, for example in the form of metal scrap. The heat necessary to melt the scrap and prevent undue cooling of the bath is generated by directing a jet of neutral gas entraining carbon against the surface of the melt at a supersonic velocity while oxygen for refining purposes is directed at the surface from separate and non-shrouding jets and the metal is bottom blown by neutral gas to prevent excessive foaming of the slag.

JP-A-61284512 discloses the production of high chrome steel by mixing chrome ore and coke powders in a blowing nozzle and blowing the mixture into the firing point of the molten iron both to melt and reduce the chrome ore.

GB-A-2 054 655, GB-A-2 122 649, and JP-A-58207313 relate to basic oxygen steel making processes in which molten metal is top-blown with oxygen and bottom blown with a different gas. Solids may be introduced with the gases.

JP-A-61106744A relates to the introduction of oxygen and solids into a furnace through tuyeres during the manufacture of stainless steel.

SUMMARY OF THE INVENTION

According to the present invention there is provided a method of refining a ferroalloy, including the step of blowing molecular oxygen or a gas mixture including molecular oxygen into a melt of the ferroalloy, wherein a metallurgically acceptable particulate material is introduced from above into the melt, the particulate material being carried into the melt in a first supersonic gas jet which travels to the melt shrouded by a second gas jet, and the second gas jet is a supersonic gas jet.

Preferably, only part of the molecular oxygen is supplied from below the surface of the melt in the method according to the invention.

By the term "ferroalloy" as used herein is meant an alloy which contains at least 10% by weight of iron. Typically, the ferroalloy contains at least 30% by weight of iron.

The metallurgically acceptable particulate material acts as a coolant and is preferably selected from metals that are to be included in the refined alloy, alloys of such metals, and oxides of such metals, and mixtures thereof.

The introduction of the metallurgically acceptable particulate coolant material into the melt has a coolant effect that helps to limit or control the temperature rise resulting from the exothermic reaction between carbon and oxygen to form carbon monoxide. There are various contributions to the cooling effect. Firstly, the particulate material is normally introduced at a temperature below that of the melt and therefore has a sensible cooling effect. Secondly, in the case of metallic particulate materials, their enthalpy of melting has an additional cooling effect. Thirdly, in the case of metal oxides their introduction provides an additional oxidising agent to the molecular oxygen or gas mixture comprising molecular oxygen which is introduced into the melt of the ferroalloy. Accordingly, the rate at which the molecular oxygen or gas mixture comprising molecular oxygen is introduced into the melt can be set lower than in a comparable conventional process. Since the reaction between the oxide and carbon is endothermic whereas the reaction between oxygen and carbon is exothermic, employing the oxide as oxidant in addition to molecular oxygen limits the temperature rise that takes place during refining. The method according to the invention is therefore believed to entail less damage than a conventional method to the refractory lining of the converter in which the ferroalloy is refined. As a result, there is a less frequent need to reline the converter.

Another advantage of the method according to the invention is that it enables the productivity of the converter to be increased.

In the refining of ferrochrome or stainless steel by the method according to the invention, the particulate material preferably comprises an oxide of chromium, typically chromium (III) oxide. A particularly preferred form of the chromium oxide is chromite which is a mixed oxide of iron and chromium. The particulate material may also comprise particles of the very crude ferroalloy that is refined by the method according to the invention.

In the refining of ferromanganese by the method according to the invention, the said oxide of the alloying element is preferably an oxide of manganese, typically manganese (II) oxide.

The mean particle size of the metallurgically acceptable particulate material is preferably less than 5 mm. It is particularly preferred that a fine particulate material is used. A fine particulate material is one that if it were simply fed under gravity into a converter in which the method according to the invention would be performed, it would not penetrate the surface of the molten metal and would therefore have at most only a negligible cooling action. Most preferably, the mean particle size of the metallurgically acceptable particulate material is 1 mm or less.

In the refining of ferrochrome by the method according to the invention, two additional advantages arise from employing fine particles of chromite as the metallurgically acceptable particulate material. First, a relatively rapid rate of reaction between the oxide and the carbon can be achieved in comparison with larger particle sizes. Second, in some examples of the method according to the invention, the fine particles of chromite may be an ore obtained as a waste material in the manufacture of the crude ferrochromium. The crude ferrochromium is typically formed by reacting carbon with chromite at elevated temperature in an electric arc furnace to form liquid ferrochrome and a slag. The charge to the electric arc furnace typically also includes basic flux-forming constituents such as lime. Mining the chromite ore generates large quantities of fine particulates that can be utilised only to a limited extent in the arc furnace reduction step. Fines tend to reduce the permeability of the arc furnace burden and this leads to eruptions of hot gases that make control of the process problematic. Even with limited fines addition the hot gas that flows from the top of the furnace will contain suspended fine particles of chromite. These particles can be recovered and in combination with mining wastes can form at least part of the chromite that is introduced from above into the melt in preferred examples of refining ferrochromium by the method according to the invention. The size of these particles is such that if they were simply fed under gravity into a converter in which the method according to the invention would be performed, they would not penetrate the surface of the molten ferrochrome and would therefore have at most only a negligible reducing action. Analogous advantages can be achieved by employing as the metallurgically acceptable particulate material fine particulate charge chrome that is also obtained as a waste material in the production of the crude ferrochromium.

By introducing the metallurgically acceptable particulate material into the melt from above in a supersonic first gas jet, however, the momentum of the gas jet is such as to be able to penetrate both a slag layer on top of the surface of the molten ferroalloy being refined by the method according to the invention and the surface itself. By shrouding a first gas jet with the second jet, the rate of reduction in velocity that naturally occurs when a gas jet moves through a still atmosphere is not nearly so marked.

The second gas jet is also a supersonic jet. More preferably, the first gas jet is ejected from a first Laval nozzle at a first supersonic velocity and the second gas jet is ejected from a second Laval nozzle at a second supersonic velocity, the second supersonic velocity preferably being from 10% less than the first supersonic velocity to 10% greater than the first supersonic velocity. Both the first supersonic velocity and the second supersonic velocity are preferably in the range of Mach 1.5 to Mach 4, more preferably in the range of Mach 2 to Mach 3.

Several advantages arise from the use of a supersonic second gas jet. First, the rate of decay of the first gas jet tends to be less than when a subsonic first gas jet is employed. Accordingly, the first gas jet can be allowed to travel a greater distance before impinging upon the slag layer or the surface of the melt. The rate of damage to the Laval nozzles caused by the splashing metal or slag can thus be kept to an acceptable level. Secondly, the velocity of the second jet can be selected such that it too is able to penetrate the slag layer and the surface of the molten metal. Accordingly, any particles migrating from the first jet to the second jet are still largely carried into the molten metal. Thirdly, by forming the first and second jets at similar velocities to one another we believe that most of the particles can be confined to the first jet without migrating to the second jet.

The gas that forms the first jet may be an oxidising gas, particularly oxygen, or may be a non-oxidising gas, for example, argon. The first jet may alternatively be a mixture of an oxidising gas and a non-oxidising gas, for example, a mixture of oxygen and argon. Another alternative is to include steam in the first jet. By forming the first jet in part or entirely from oxygen, a further part of the demand of the refining method for oxidant is met with the consequence that less of the demand need be met by supplying oxygen from below the surface of the molten metal.

The second gas jet may have the same or a different composition from the first gas jet. Whereas the first gas jet is typically ejected from the first Laval nozzle at approximately ambient temperature or a temperature a little above ambient, the second gas jet may comprise burning gases. Such a "flame jet" has been found to be particularly effective in maintaining the intensity of the first gas jet.

Preferably the first and second Laval nozzles form part of a metallurgical lance comprising an axial first gas passage terminating at its outlet end in the first Laval nozzle, a shrouding gas passage about the main gas passage terminating at its outlet end in the second Laval nozzle, and a particulate material transport passage having an axial outlet which communicates with the first Laval nozzle and preferably terminates in the divergent part of the first Laval nozzle. Because the particles of the oxide are able to be introduced through the transport passage into the divergent part of the first Laval nozzle, collisions of the particles at high velocity with the walls of the first Laval nozzle can be kept to a minimum.

If the second gas jet takes the form of a flame, the shrouding gas passage preferably comprises a combustion chamber. The combustion chamber preferably has at its proximal end an inlet for oxidant and an inlet for a fluid fuel. The fuel and oxidant are typically supplied through coaxial oxidant and fuel passages. The combustion chamber can have a size and configuration such that any given proportion of the combustion of the fuel gas takes place therein.

Preferably, the metallurgically acceptable particulate material is introduced into the melt continuously during a first part of a refining operation. If desired introduction of the first gas jet can continue after the introduction of the metallurgically acceptable particulate material has ceased. If the first gas jet comprises oxygen, its supply is preferably ceased before the end of the refining operation.

BRIEF DESCRIPTION OF THE DRAWINGS

The method according to the present invention will now be described by way of example with reference to the accompanying drawings, in which.

DESCRIPTION OF THE INVENTION

Figure 1:
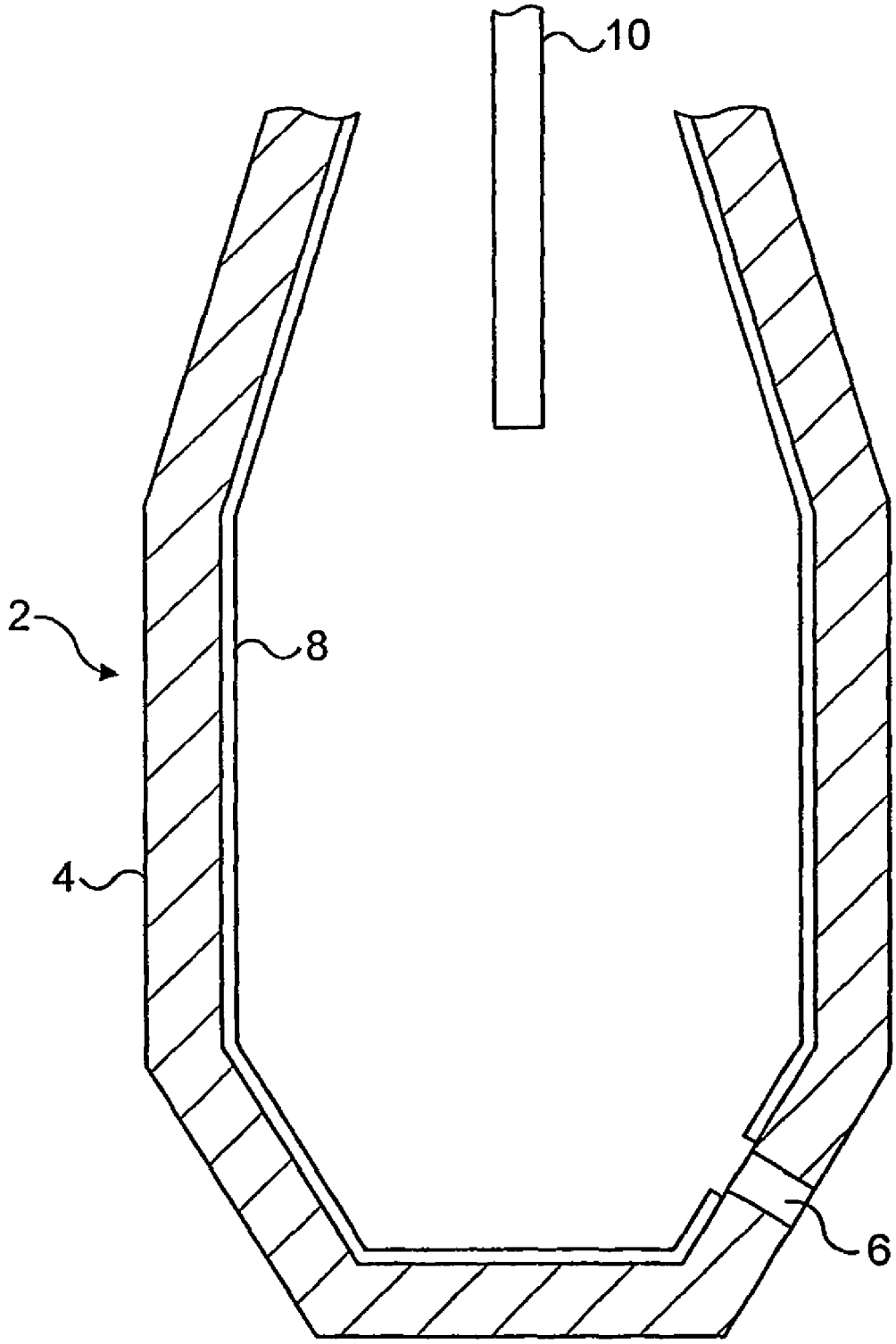
FIG. 1 is a schematic side view of a converter fitted with a lance and thereby adapted to perform the method according to the present invention.

Referring to FIG. 1 of the drawings, a converter 2 of conventional kind takes the form of a tiltable, open-topped vessel 4. At or near its bottom the vessel is provided with a plurality of tuyeres 6, of which only one is shown in FIG. 1. The interior surfaces of the converter are provided with a refractory lining 8.

In operation, the converter 2 is employed to refine, that is decarburise, a crude ferrochromium (ferrochrome) alloy containing a relatively high proportion of carbon (say, in the order of 6% by weight). An object of the refining step is to reduce the carbon content of the ferrochrome to below 2% by weight.

In operation, the converter is charged with molten crude ferrochrome. Fluxing agents such as lime are typically introduced into the ferrochrome. The ferrochrome is refined by blowing oxygen, or a mixture of oxygen and non-reactive gas or vapour such as argon through the tuyeres 6. The oxygen reacts exothermically with the carbon in the ferrochrome to form carbon monoxide. The heat of the reaction between the carbon and the oxygen maintains the ferrochrome in molten state. A slag is formed by reaction of impurities in the ferrochrome with the fluxing agents and a slag layer is established on the surface of the ferrochrome.

The crude ferrochrome is typically formed in a separate vessel (not shown), for example, an electric arc furnace. In this operation a solid charge comprising pieces of carbon, pieces of chromite, and basic fluxing agents (such as lime) is introduced into an electric arc furnace, and an arc is struck between one or more carbon electrodes and the charge. As a result a sufficient temperature is created to melt the charge. The carbon reacts with the chromite to form ferrochrome and silica, the latter contributing to the slag layer. The resulting ferrochrome has a high carbon content. The molten ferrochrome and slag are tipped out of the electric arc furnace into a suitable collecting vessel (not shown) which is employed to transfer the molten metal into the converter 2. Once the converter 2 has been charged with the high carbon molten ferrochrome and any fluxing agents such as lime, at least one lance 10 is lowered into position over the molten metal and is maintained in that position throughout the refining of the ferrochrome.

Figure 2:
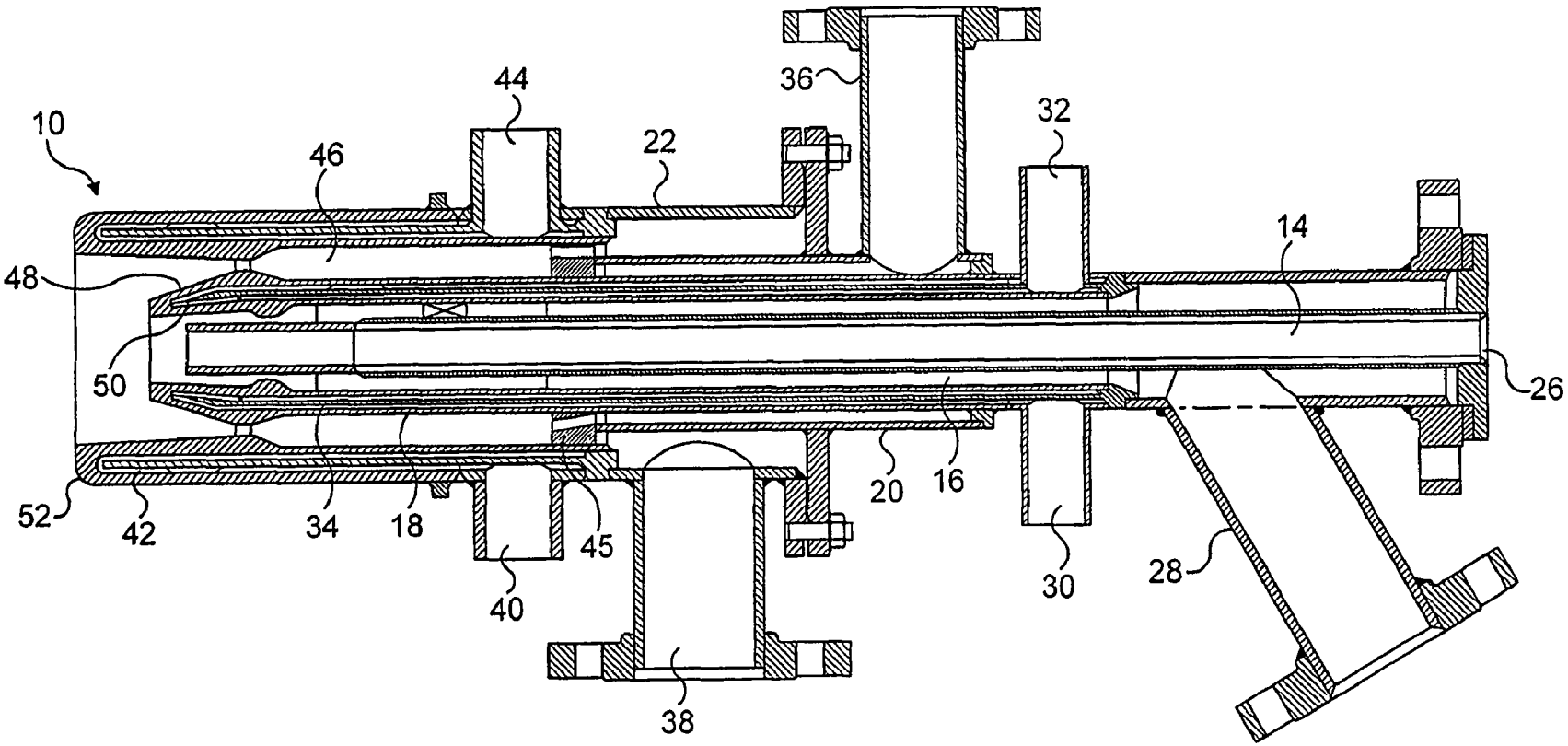
FIG. 2 is a side elevation, partly in section of the lance shown in FIG. 1.
Figure 3:
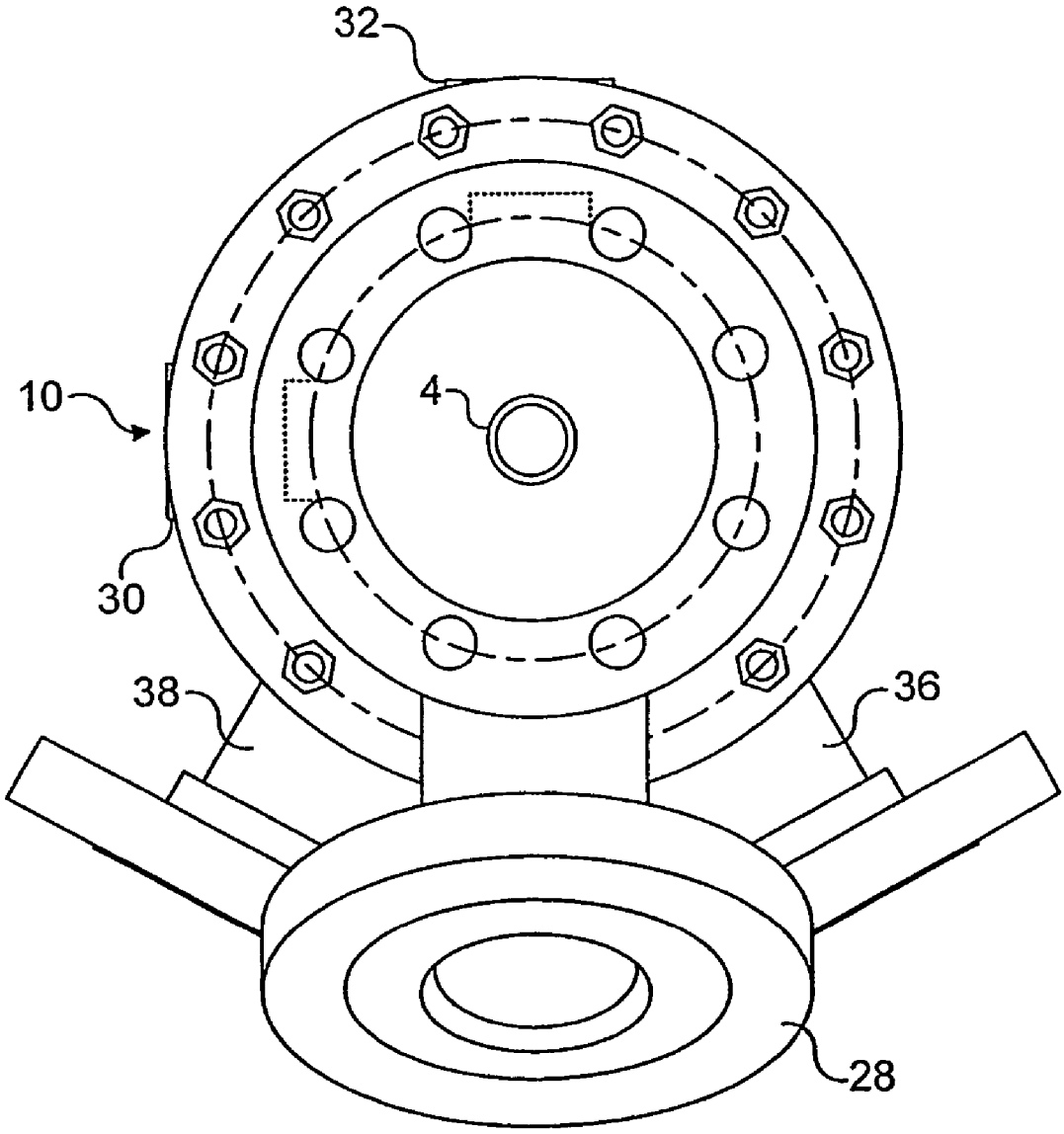
FIG. 3 is a view from its proximal end of the lance shown in FIG. 2.

The metallurgical lance 10 is shown in more detail in FIGS. 2 and 3 to which reference is now made. The metallurgical lance 10 comprises an array of six coaxial tubes or pipes. In sequence, from the innermost tube to the outermost tube, there is a particulate material tube 14, a main gas tube 16 for a first gas, an inner tube 18 for water, a tube 20 for fuel gas, a tube 22 for oxidant (typically, commercially pure oxygen) and an outer tube 24 for water. Each of the tubes 14, 16, 18, 20, 22 and 24 has an inlet at or near the proximal end of the lance 10. In addition, there are outlets from the inner water tube 18 and the outer water tube 24. Thus, there is an axial inlet 26 at the proximal end of the lance 10 for a carrier gas, typically air, employed to transport the particulate material to the distal end of the lance 10. The inlet 26 may communicate with a passage or passages (not shown) for introducing the particulate material (chromite) into the carrier gas. The carrier gas may be supplied at a relatively low pressure such that its velocity along the particulate material transport tube is no more than about 100 meters per second and the particulate material is carried therein as a dilute phase. Alternatively, the particulate material may be transported as a dense phase in a high pressure carrier gas.

The main gas tube 16 has an inlet 28. Typically, the first gas is oxygen or oxygen-enriched air and the inlet 28 communicates with a source (not shown) of oxygen or oxygen-enriched air. The inner water tube 18 has an inlet 30 and an outlet 32 for the water. The tube 18 is provided with a tubular baffle 34. In operation, cooling water passes over the inner surface of the baffle 34. The provision of the inner cooling water protects the inner parts of the lance 10 from the effects of the high temperature environment in which it operates.

The fuel gas tube 20 communicates at its proximal end through an inlet 36 with a source (not shown) of fuel gas (typically, natural gas). Similarly, an inlet 38 places the oxidant tube in communication with a source (not shown) of oxygen, typically oxygen or oxygen-enriched air.

The outer water tube 24 communicates at its distal end with another inlet 40 for cooling water. The outer tube 24 contains a tubular baffle 42. The arrangement is such that coolant water flows through the inlet 40 and passes over the outer surface of the baffle 42 as it flows from the proximal to the distal end of the lance 10. The cooling water returns in the opposite direction and flows away through an outlet 44 at the proximal end of the lance 10. The outer water tube 24 enables the outer parts of the lance 10 to be cooled during its operation in a high temperature environment.

The fuel gas tube 20 and the oxidant tube 22 terminate further away than the other tubes from the distal end of the lance 10. The tubes 20 and 22 terminate in a nozzle 45 at the proximal end of an annular combustion chamber 46. In operation, the oxidant and fuel gas are supplied at elevated pressure, typically in the order of 5 bar for the natural gas and 11 bar for the oxygen, and pass through the nozzle 45 and mix and combust in the combustion chamber 46. Typically, the oxidant (oxygen) and the fuel gas are supplied at rates so as to give stoichiometric combustion, although, if desired, the fuel gas and the oxidant may be supplied at rates so as to give an excess of fuel gas or an excess of oxidant in the flame.

The main gas tube 16 provides the passage for the first gas through the lance 10. The main gas tube terminates in a first or inner Laval nozzle 48. The first Laval nozzle 48 has an annular cooling passage 50 formed therein. The cooling passage 50 is contiguous to an inner water passage defined between the inner surface of the tube 18 and the outer surface of the main gas tube 16. The baffle 34 extends into the passage 50 so as to direct the flow of water coolant.

The combustion chamber 46 terminates at its distal end in a second or outer Laval nozzle 52. The arrangement of the combustion chamber 46 and the Laval nozzle 52 causes the flame formed in the combustion chamber 46 to be accelerated to a supersonic velocity in operation of the lance 10. This flame shrouds the first gas jet issuing from the first Laval nozzle 48. The second Laval nozzle 52 is formed as a double-walled member. The outer wall of the second Laval nozzle 52 is contiguous with the distal end of the outermost tube 24. The outermost tube 24 is thus able to provide cooling to the second Laval nozzle 52 in operation of the lance 10, the baffle 42 extending into the annular space defined by the inner and outer walls of the second Laval nozzle 52. The first or inner Laval nozzle 48 is set back relative to the tip of the second or outer Laval nozzle 52 and terminates in the divergent portion of the second Laval nozzle 52.

In operation, the first gas jet exits the Laval nozzle 48 at a velocity typically in the range of Mach 2 to Mach 3. Carrier gas containing particles of chromite passes out of the distal end of the tube 14 into the accelerating first gas at a region in the divergent part of the inner Laval nozzle 48. The chromite is thus carried out of the Laval nozzle 48 at supersonic velocity.

The first gas jet is shrouded by an annular supersonic flow of burning hydrocarbon gas exiting the combustion chamber 46. The exit velocity of the burning hydrocarbon gas flame from the Laval nozzle 52 is typically from 90 to 110% of the exit velocity of the first gas jet. By adopting similar exit velocities, mixing of the main gas jet with its flame shroud is kept down.

The metallurgical lance 10 shown in the drawings is simple to fabricate and may be formed primarily of stainless steel. The Laval nozzle 48 and 52 can be attached to the lance by suitable welds. The nozzle 45 at the inlet to the combustion chamber 46 may also be welded into position.

In use, the lance 10 is used to provide oxygen and chromite as decarburising agents to the molten ferrochrome. The lance 10 is positioned such that its tip is in the range of 1.5 to 2.0 meters vertically above the surface of the molten metal and its axis in a vertical position. The supersonic shroud is able to maintain the integrity of the first gas jet for distances in the range of 200 to 300 D where D is the diameter of the Laval nozzle 48 at its exit. There is therefore no difficulty in obtaining adequate penetration of the chromite and the oxygen into the melts.

Simultaneously with the commencement of the introduction of the oxygen and chromite into the ferrochrome from above a mixture of oxygen and one or both of argon and steam is typically blown into the molten metal from below through the tuyeres 6. Whereas the oxygen reacts exothermically with the carbon to form carbon monoxide, the reaction between the chromite and the carbon to form chromium metal and carbon monoxide is endothermic. The chromite thus serves to moderate or eliminate the temperature rise that would occur were no chromite to be added. It is therefore particularly advantageous to introduce the chromite during at least an initial period of the blow when the rate of decarburisation is at its highest. On the other hand, during the latter stages of the blow, it is often desirable not to introduce any chromite and to increase the ratio of non-reactive to oxidising gases that are blown into the molten ferrochrome. The purpose of this increase is to ensure that the oxygen partial pressure is never so great that there is any appreciable oxidation in the melt of chromium to an oxide of chromium. Indeed, throughout the entire refining operation the method according to the invention is operated such that the prevailing conditions favour oxidation of carbon over oxidation of chromium.

The blowing of the gas mixture through the tuyeres 6 is continued for a sufficient period of time for the carbon level in the ferrochrome to be reduced to less than two percent. The lance 10 is then withdrawn if this has not already been done and vessel 4 is tilted so as to empty all the liquid ferrochrome into a collecting vessel (not shown). The slag is retained for recovery of chromium (III) oxide. The ferrochrome product can typically be poured into suitable moulds (not shown).

Two examples of the refining of ferrochrome have been simulated and are given below. Example 1 is a comparative example and Example 2 is in accordance with the invention.

Example 1

Comparative

A charge of molten ferrochrome (41% Fe, 53% Cr, 6% C) containing 6% by weight of carbon was blown for 47 minutes at a rate of 1740 normal cubic meters per hour through the tuyeres 6 with a mixture of 22 parts by volume of oxygen and 7 parts per volume of steam. The composition and flow rate of the gas mixture were then changed. The flow rate was reduced to 1200 normal cubic meters per hour and the composition was altered to 13 parts by volume of steam to 7 parts by volume of oxygen. The blow was continued for another 24 minutes. 30.8 tonnes of ferrochrome (42.4% Fe, 55.6% Cr) containing 1.5% by weight of carbon was obtained. The maximum temperature of the melt was 1699° C.

Example 2

A charge of molten ferrochrome (41% Fe, 53% Cr, 6% C) containing 6% by weight of carbon was blown for 35 minutes at a rate of 1380 normal cubic meters per hour through the tuyeres 6 with a mixture of 14 parts by volume of oxygen and 9 parts by volume of steam. The mixture was then changed and the molten ferrochrome was blown for a further twelve minutes with 1080 normal cubic meters per hour with a mixture of one part per volume of oxygen and one part per volume of steam. In addition, during the first twenty one minutes of the refining operation particulate chromite was continuously injected from above into the melt from the lance 10. The chromite was carried by a jet of oxygen flowing at a rate of 1500 normal cubic meters per hour. The chromite was injected at a rate of 60 kg/minute. While the chromite was injected the temperature of the melt was maintained below 1600° C. withstanding the fact that the total rate of flow of molecular oxygen into the melt was greater than in Example 1. Once feeding of the chrome had finished, oxygen injection from the lance was continued so as to raise the temperature of the melt to above 1600° C. After five minutes had elapsed from the ending of the chromite injection, the oxygen injection from the lance was also ceased.

At the end of the blow 31.2 tonnes of ferrochrome containing less than 2% by weight of carbon were tapped at a temperature of 1667° C., the maximum temperature obtained at any stage in the blow.

It can be seen that Example 2 (in accordance with the invention) gives a substantially higher productivity of ferrochrome in tonnes per hour than Example 1. In Example 2 the productivity is 39.7 tonnes per hour; in Example 1 it is 26.4 tonnes per hour. Further, the flow rate through the tuyeres 6 is substantially reduced in Example 2 compared with Example 1.

Other advantages of the invention are evident from Example 2. For example, the rate of decarburising is higher but the maximum melt temperature obtained is less than in Example 1. Further the maximum flow rate of gas through the tuyeres is less in Example 2 than Example 1. Therefore the regimen of Example 2 is likely to be less wearing on the refractory 8 of the vessel 4 than the regimen of Example 1.

Example 3

A charge of molten ferrochrome (41% Fe, 53% Cr, 6% C) containing 6% by weight of carbon was blown through the tuyeres 6 for an initial period of 40 minutes at a rate of 1410 normal cubic meters per hour with a mixture of steam and oxygen in the ratio of 53 parts by volume of steam to 88 parts by volume of oxygen. For the first 35 minutes of this period particulate ferrochrome (41% Fe, 53% Cr, 6% C) was blown through the lance 10 into the melt at the rate of 80 kg/hr. The particulate ferrochrome was carried in a jet of oxygen flowing at a rate of 1500 normal cubic meters per hour. After the first 35 minutes, the supply of the oxygen and the ferrochrome through the lance 10 was ceased. At the end of the initial period of 40 minutes the combined rate of supply of oxygen and steam through the tuyeres 6 was reduced to 1010 normal cubic meters per hour and the ratio of steam to oxygen was increased to 53 parts by volume of steam to 48 parts by volume oxygen. The blow continued for a further 21 minutes.

At the end of the blow 35.5 tonnes of ferrochrome containing less than 2% by weight of carbon were tapped at a temperature of 1630° C. The maximum temperature of the melt at any stage was 1680° C.

It can be seen that Example 3 (in accordance with the invention) gives a substantially higher productivity in tonnes per hour than Example 1. In Example 3 the productivity is 34.9 tonnes per hour. In Example 1 it is 26.4 tonnes per hour. Further the flow rate through the tuyeres 6 is substantially reduced in Example 3 compared with Example 1.

Moreover, the advantages of Examples 2 and 3 can be obtained using the injection of what would otherwise be waste materials through the lance 10.

It can be readily understood that the method according to the invention is applicable to the refining of ferroalloys other than ferrochrome. It can for example be adapted to the manufacture of stainless steel by either an AOD or CLU process. The method according to the invention is also applicable to the refining of ferromanganese and ferrovanadium, for example.

The invention claimed is:

1. A method of refining a ferroalloy, comprising blowing a gas selected from molecular oxygen and a gas mixture including molecular oxygen into a melt of the ferroalloy and exothermically reacting the molecular oxygen with carbon in the melt; introducing a metallurgically acceptable particulate material, capable of providing a cooling effect, from above into the melt in a first supersonic gas jet which travels to the melt shrouded by a second supersonic gas jet, wherein the second supersonic gas jet is formed of burning gases; and forming velocities of the first and the second supersonic gas jets for controlling migration of said particulate material between said first and second supersonic gas jets, the velocity of the second supersonic gas jet being from 10% less to 10% greater than the velocity of the first supersonic gas jet.

2. A method according to claim 1, wherein the metallurgically acceptable particulate material is selected from the group consisting of metals that are to be included in the refined alloy, alloys of said metals, oxides of said metals, and mixtures thereof.

3. A method according to claim 1, wherein the ferroalloy contains at least 30% by weight of iron.

4. A method according to claim 1, wherein the ferroalloy is ferrochrome and the metallurgically acceptable particulate material comprises an oxide of chromium.

5. A method according to claim 4, wherein the oxide of chromium is chromite.

6. A method according to claim 1, wherein the metallurgically acceptable particulate material comprises ferrochrome.

7. A method according to claim 1, wherein the ferroalloy is a stainless steel and the metallurgically acceptable particulate material is an oxide of chromium.

8. A method according to claim 1, wherein the ferroalloy is ferromanganese and the metallurgically acceptable particulate material is an oxide of manganese.

9. A method according to claim 1, wherein the metallurgically acceptable particulate material is introduced into the melt in fine particulate form.

10. A method according to claim 9, wherein the metallurgically acceptable particulate material has a mean particle size of 1 mm or less.

11. A method according to claim 1, wherein a gas that forms the first supersonic gas jet is selected from the group consisting of an oxidizing gas, a non-oxidising gas, or a mixture of an oxidising gas and a non-oxidising gas.

12. A method according to claim 11, wherein the oxidising gas is oxygen.

13. A method according to claim 11, wherein the non-oxidising gas is selected from the group consisting of argon, steam and combinations thereof.

14. A method according to claim 1, wherein the first supersonic gas jet is ejected from a first Laval nozzle at a velocity in the range of Mach 1.5 to Mach 4 and the second supersonic gas jet is ejected from a second Laval nozzle at a velocity in the range of Mach 1.5 to Mach 4.

15. A method according to claim 14, wherein the first and second Laval nozzles form part of a metallurgical lance comprising an axial first gas passage terminating at its outlet and in the first Laval nozzle, a shrouding gas passage about a main gas passage terminating at its outlet in the second Laval nozzle, and a particulate material transport passage having an axial outlet which communicates with the first Laval nozzle.

16. A method according to claim 15, wherein the axial outlet terminates in a divergent part of the first Laval nozzle.

17. A method according to claim 15, wherein the shrouding gas passage comprises a combustion chamber.

18. A method according to claim 1, wherein the metallurgically acceptable particulate material is introduced into the melt continuously during a first part of a refining operation.

19. A method according to claim 18, wherein the first supersonic gas jet comprises oxygen and introduction of the first supersonic gas jet into the melt continues after introduction of the metallurgically acceptable particulate material into the melt has ceased.

20. A method according to claim 19, wherein introduction of the first supersonic gas jet into the melt ceases before the end of the refining operation.

21. A method of refining a ferroalloy, comprising blowing a gas selected from molecular oxygen and a gas mixture including molecular oxygen into a melt of the ferroalloy and exothermically reacting the molecular oxygen with carbon in the melt: introducing a metallurgically acceptable particulate material, capable of providing a cooling effect, from above into the melt in a first supersonic gas jet which travels to the melt shrouded by a second supersonic gas jet, wherein the ferroalloy is ferromanganese and the metallurgically acceptable particulate material is an oxide of manganese; and forming velocities of the first and the second supersonic gas jets for controlling migration of said particulate material between said first and second supersonic gas jets, the velocity of the second supersonic gas jet being from 10% less to 10% greater than the velocity of the first supersonic gas jet.

22. A method according to claim 21, wherein the ferroalloy contains at least 30% by weight of iron.

23. A method according to claim 21, wherein the metallurgically acceptable particulate material is introduced into the melt in line particulate form.

24. A method according to claim 23, wherein the metallurgically acceptable particulate material has a mean particle size of 1 mm or less.

25. A method according to claim 21, wherein a gas that forms the first supersonic gas jet is selected from the group consisting of an oxidizing gas, a non-oxidising gas, or a mixture of an oxidising gas and a non-oxidising gas.

26. A method according to claim 25, wherein the oxidising gas is oxygen.

27. A method according to claim 25, wherein the non-oxidising gas is selected from the group consisting of argon, steam and combinations thereof.

28. A method according to claim 21, wherein the first supersonic gas jet is ejected from a first Laval nozzle at a velocity in the range of Mach 1.5 to Mach 4 and the second supersonic gas jet is ejected from a second Laval nozzle at a velocity in the range of Mach 1.5 to Mach 4.

29. A method according to claim 28, wherein the first and second Laval nozzles form part of a metallurgical lance comprising an axial first gas passage terminating at its outlet And in the first Laval nozzle, a shrouding gas passage about a main gas passage terminating at its outlet in the second Laval nozzle, and a particulate material transport passage having an axial outlet which communicates with the first Laval nozzle.

30. A method according to claim 29, wherein the axial outlet terminates in a divergent part of the first Laval nozzle.

31. A method according to claim 29, wherein the shrouding gas passage comprises a combustion chamber.

32. A method according to claim 21, wherein the metallurgically acceptable particulate material is introduced into the melt continuously during a first part of a refining operation.

33. A method according to claim 32, wherein the first supersonic gas jet comprises oxygen and introduction of the first supersonic gas jet into the melt continues after introduction of the metallurgically acceptable particulate material into the melt has ceased.

34. A method according to claim 33, wherein introduction of the first supersonic gas jet into the melt ceases before the end of the refining operation.

* * * * *